US010029494B2

(12) United States Patent
Takahashi

(10) Patent No.: US 10,029,494 B2
(45) Date of Patent: Jul. 24, 2018

(54) PRINTER

(71) Applicant: Brother Kogyo Kabushiki Kaisha, Nagoya-shi, Aichi-ken (JP)

(72) Inventor: Toshihiro Takahashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/461,581

(22) Filed: Mar. 17, 2017

(65) Prior Publication Data

US 2017/0267000 A1 Sep. 21, 2017

(30) Foreign Application Priority Data

Mar. 18, 2016 (JP) ..... 2016-055667

(51) Int. Cl.
*B41J 15/04* (2006.01)
*B41J 3/407* (2006.01)
*B41J 29/02* (2006.01)

(52) U.S. Cl.
CPC ..... *B41J 15/044* (2013.01); *B41J 3/4075* (2013.01); *B41J 29/02* (2013.01)

(58) Field of Classification Search
CPC ..... B41J 29/026; B41J 29/023; B41J 29/02; B41J 29/00; B41J 29/13; B41J 15/044; B41J 15/04; B41J 15/042; B41J 2/32; B41J 11/0045; B41J 11/04; B41J 3/4075
See application file for complete search history.

(56) References Cited

U.S. PATENT DOCUMENTS

2014/0147187 A1 5/2014 Jo et al.
2014/0340462 A1* 11/2014 Kuronuma ..... B41J 3/4075 347/212
2015/0165802 A1* 6/2015 Wong ..... B41J 29/13 347/110
2017/0028747 A1* 2/2017 Kanda ..... B41J 11/663

FOREIGN PATENT DOCUMENTS

JP H11-084982 A 3/1999
JP 2004-205910 A 7/2004
JP 2006-349022 A 12/2006
JP 2014-104697 A 6/2014

* cited by examiner

*Primary Examiner* — Kristal Feggins
(74) *Attorney, Agent, or Firm* — Banner & Witcoff, Ltd.

(57) ABSTRACT

The disclosure discloses a printer including an opening/closing lid, a first spring member, and a second spring member. The second spring member is separated from the opening/closing lid without applying an urging force in the closing direction to the time the opening/closing lid has pivoted from a closed state by a first predetermined angle and comes into contact with the opening/closing lid to apply the urging force when the opening/closing lid has pivoted from the closed state in the opening direction by the first predetermined angle. The opening/closing lid comprises a contacting part configured to be separated from a contacted part of the housing in the closed state, and to come into contact with the contacted part from the time the opening/closing lid has pivoted from the closed state by a second predetermined angle to the time the opening/closing lid has pivoted by a third predetermined angle.

11 Claims, 17 Drawing Sheets

[FIG. 1]
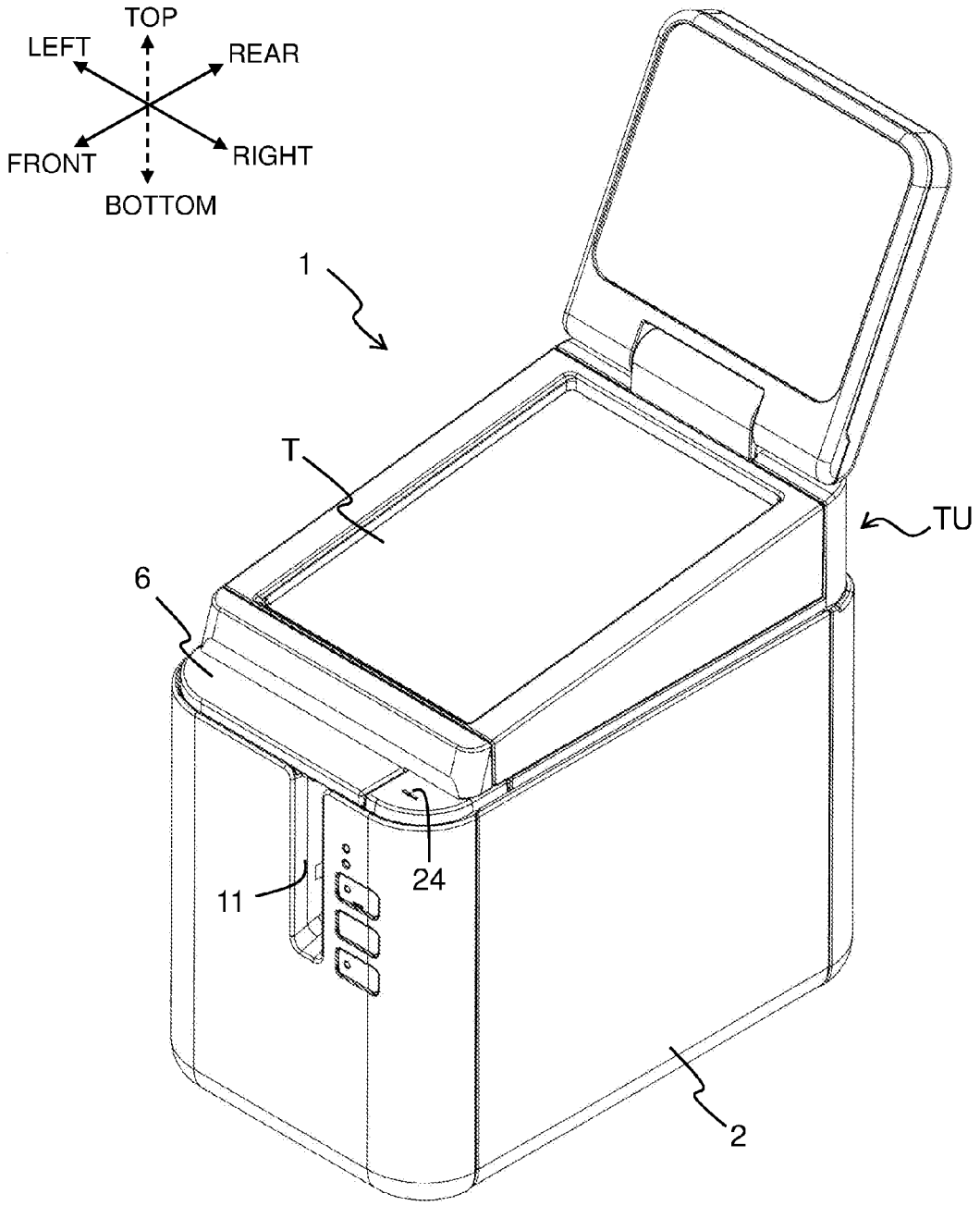

[FIG. 2]
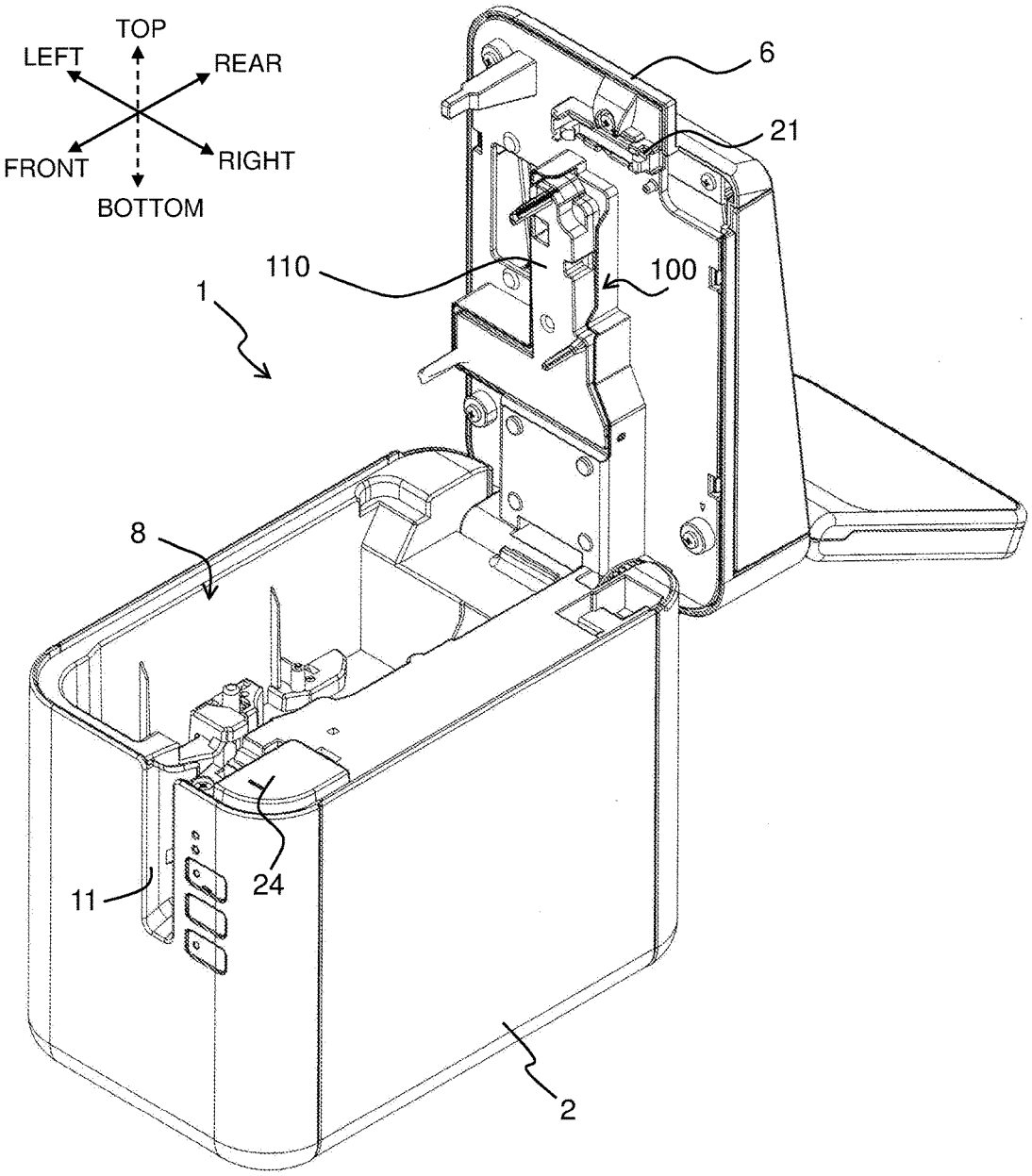

[FIG. 3]
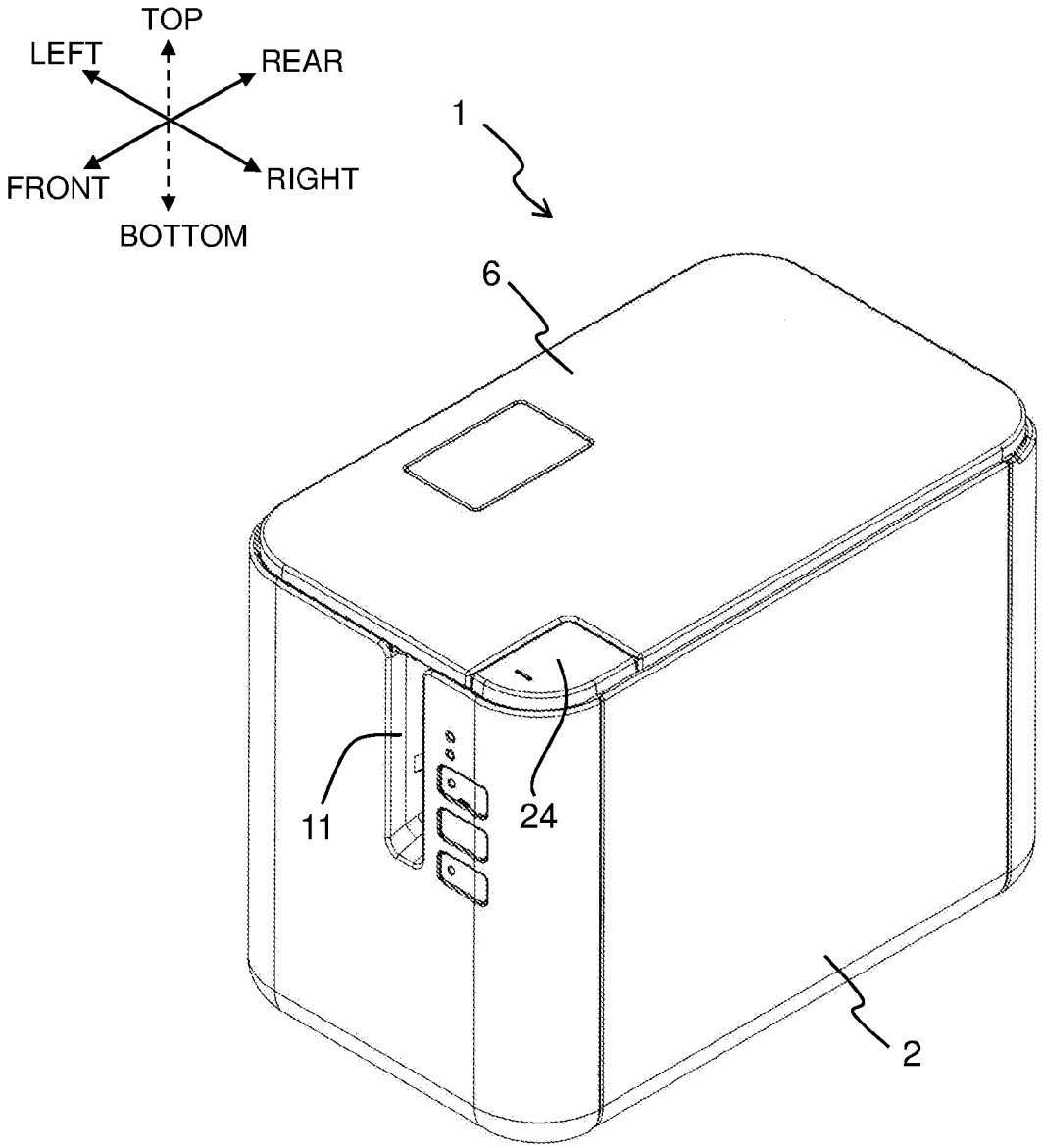

[FIG. 4]
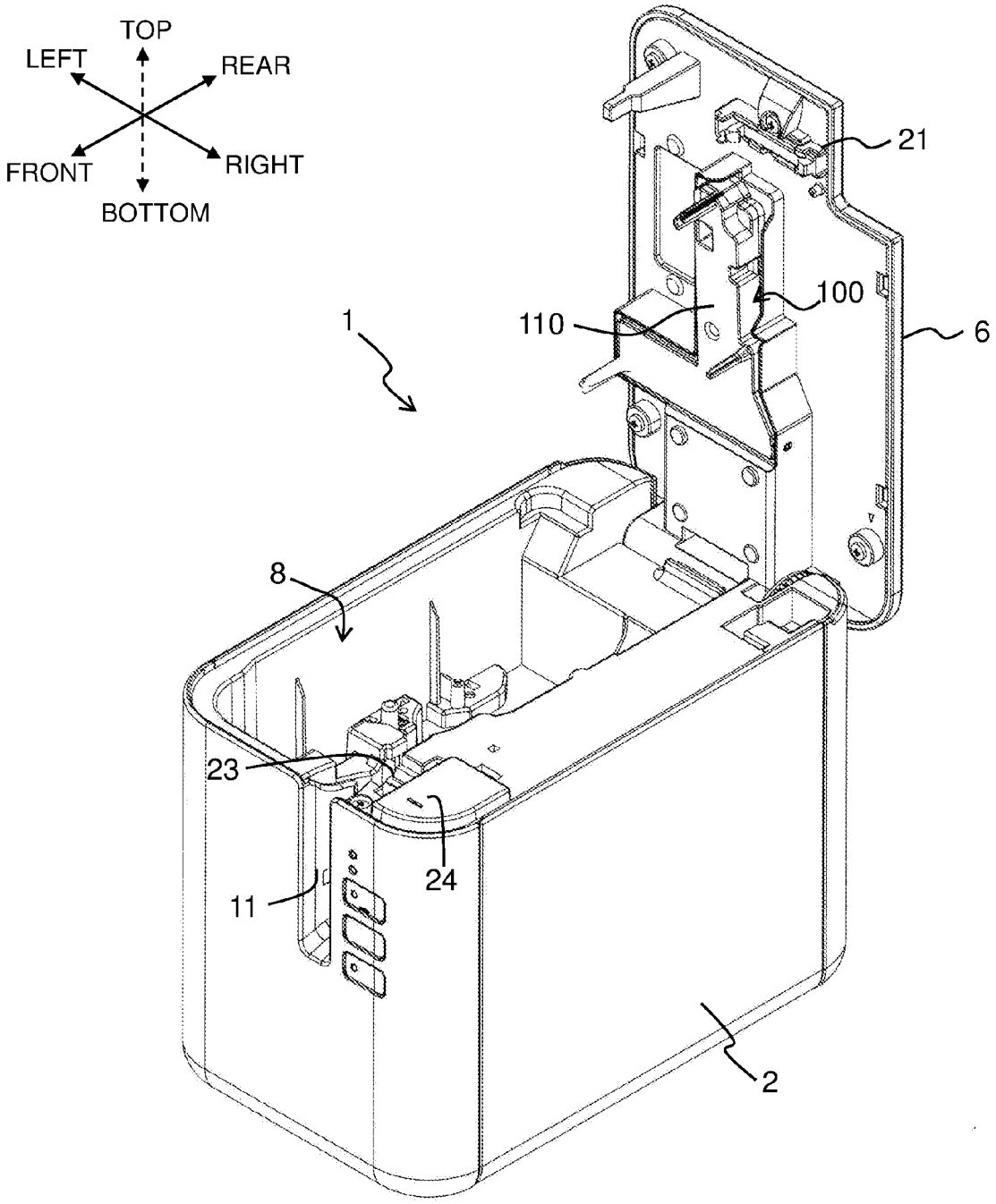

[FIG. 5]
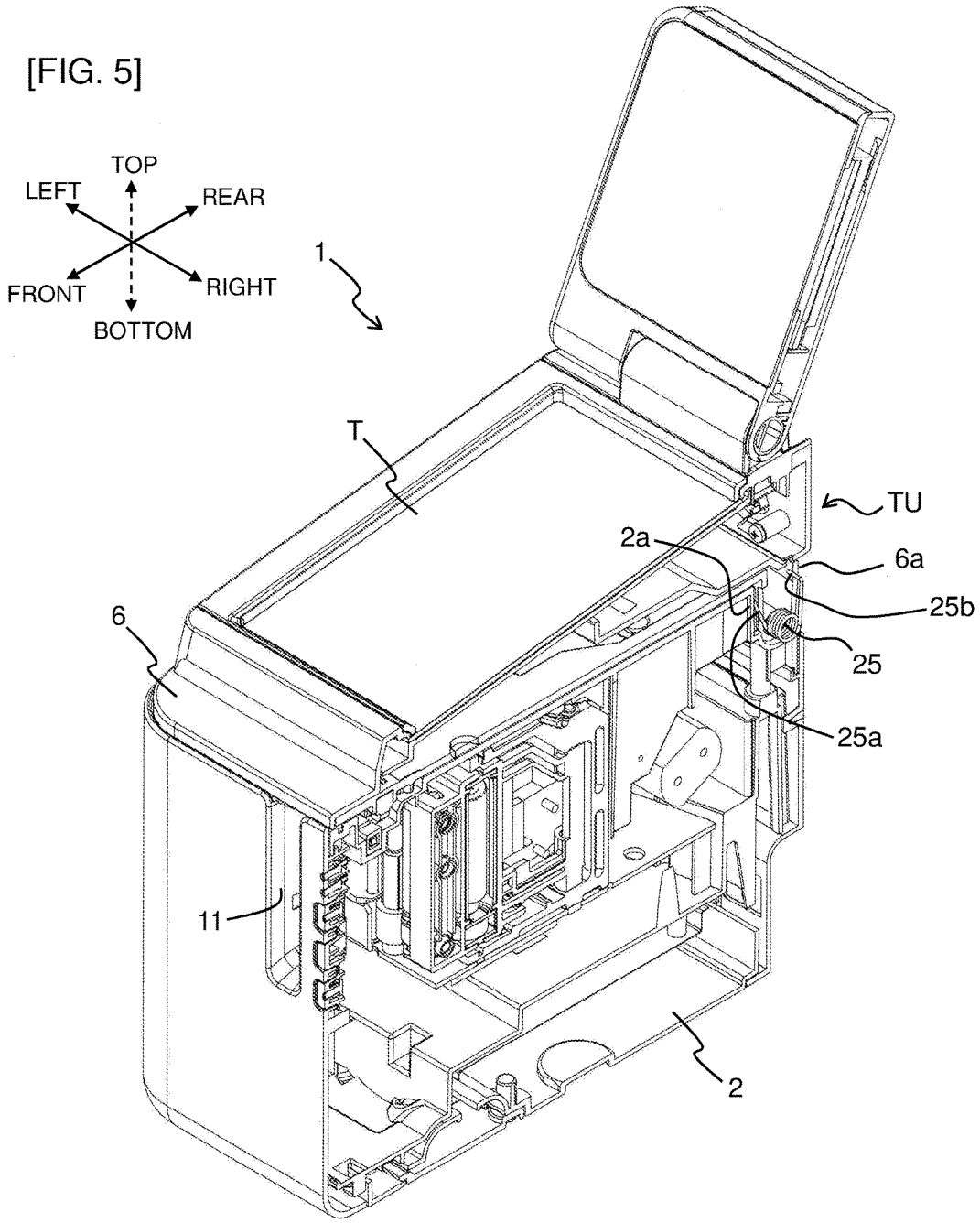

[FIG. 6A]
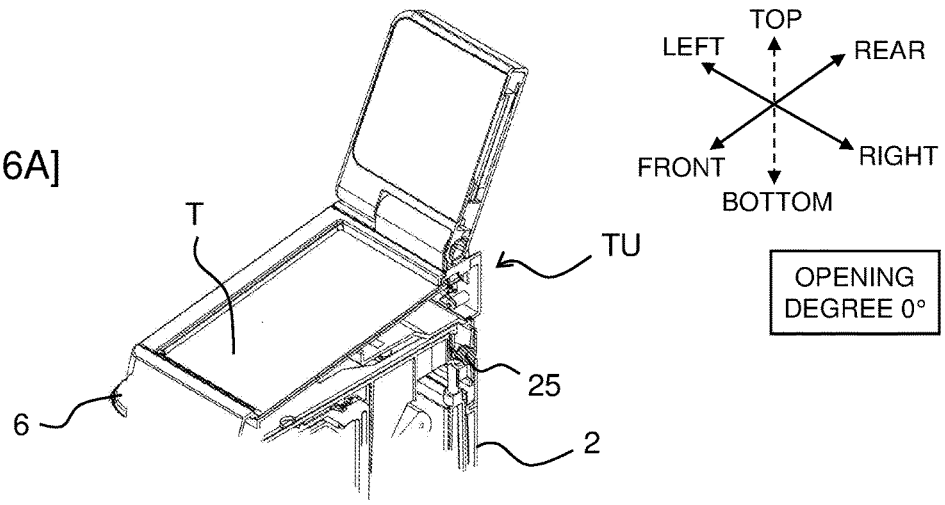
[FIG. 6B]
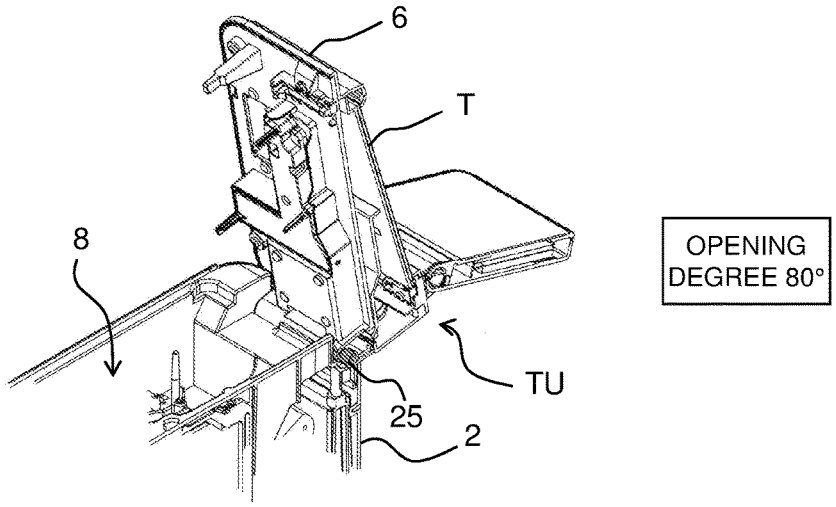
[FIG. 6C]
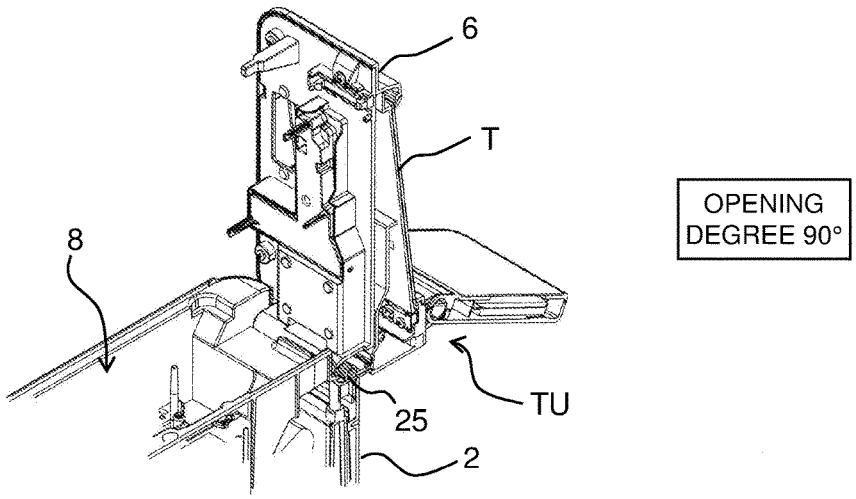

[FIG. 7A]
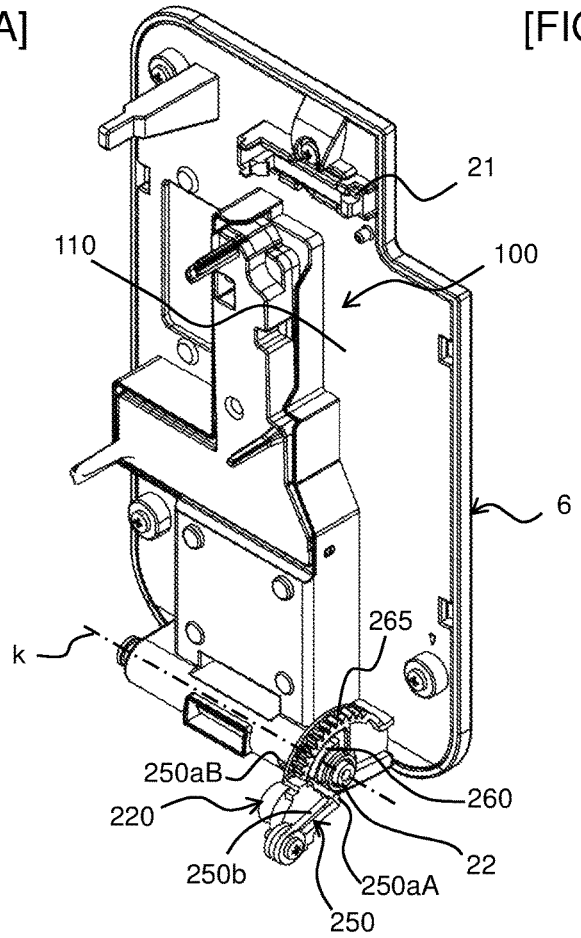
[FIG. 7B]
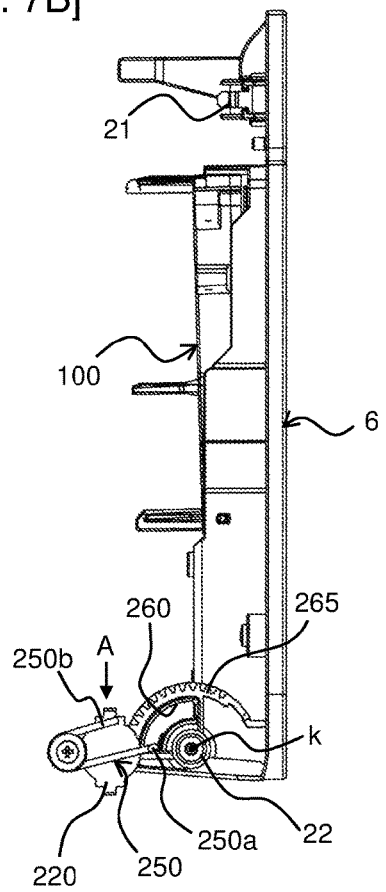
[FIG. 7C]
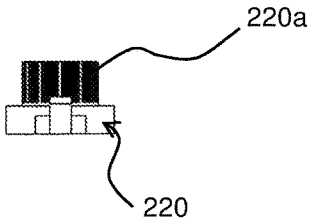
[FIG. 7D]
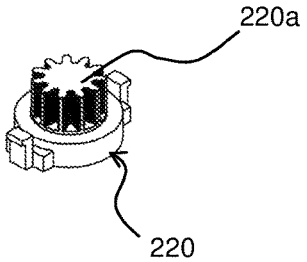

[FIG. 8]
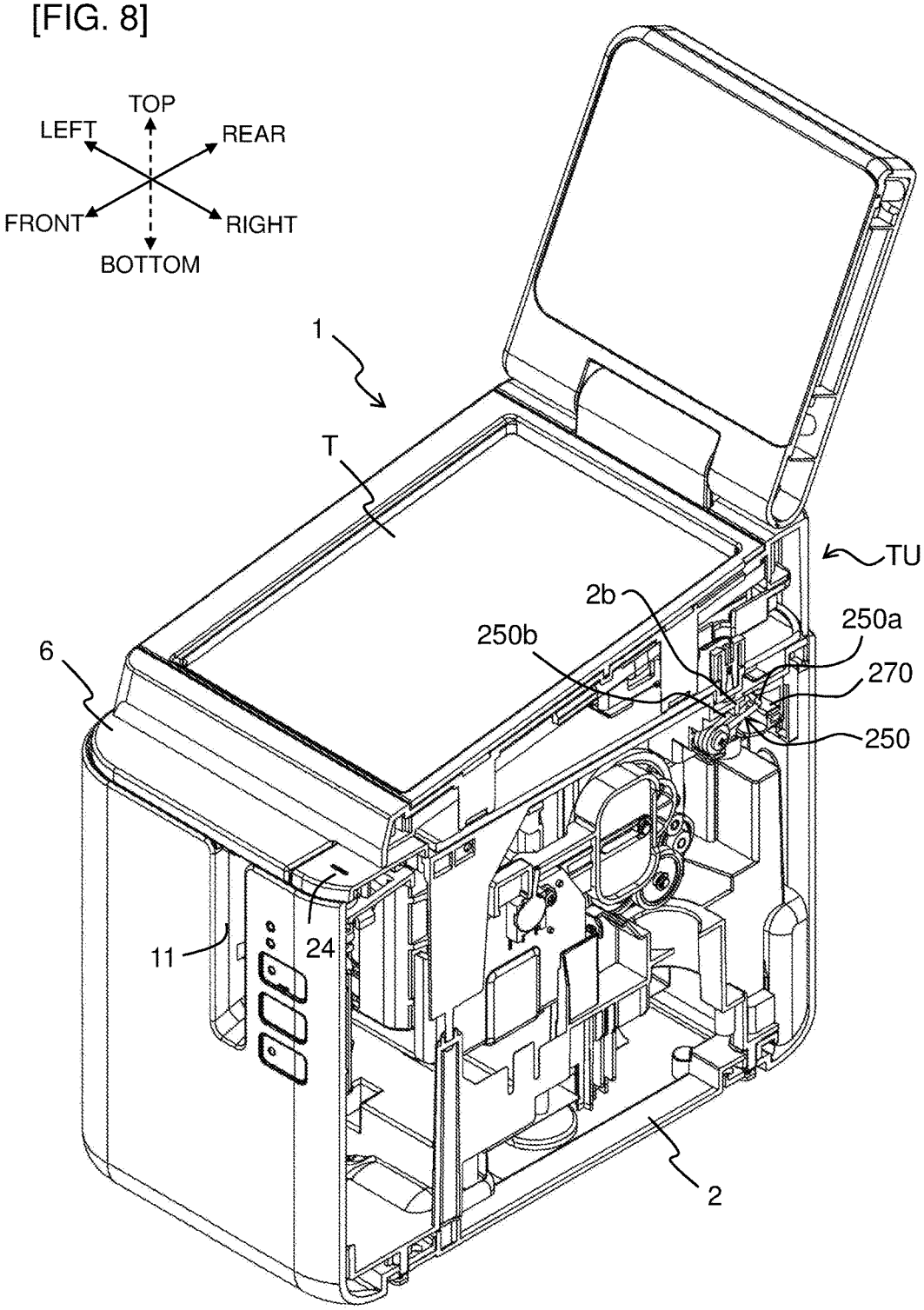

[FIG. 9A]
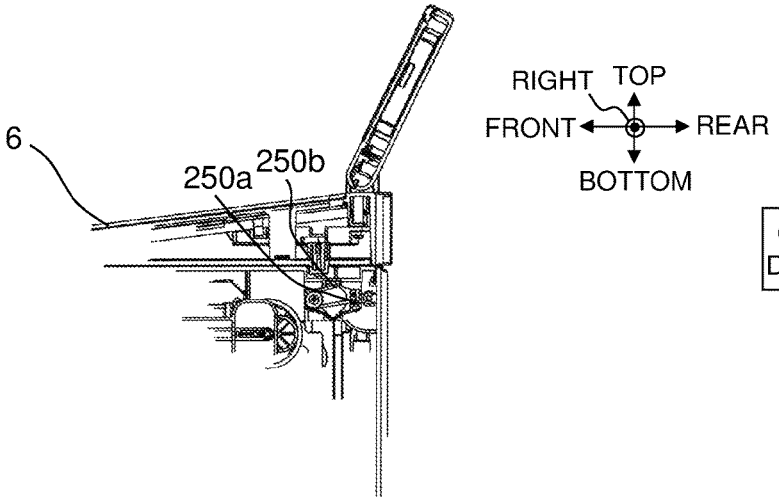
[FIG. 9B]
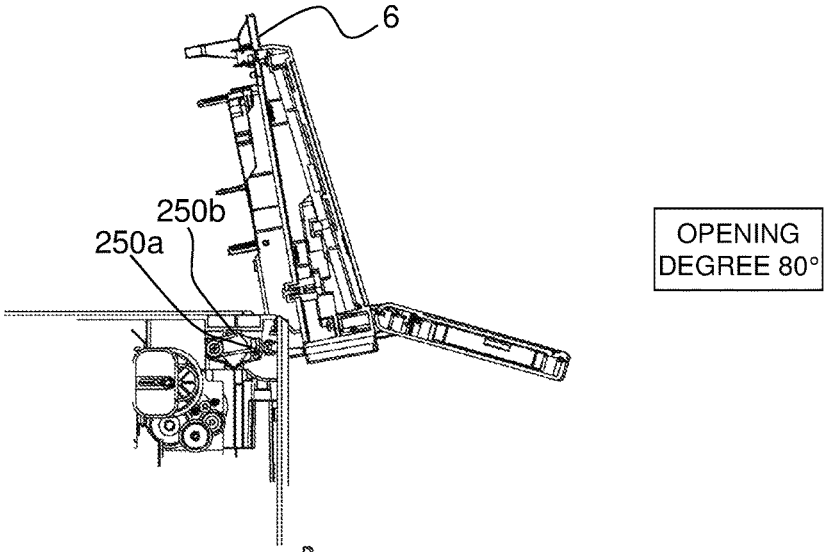
[FIG. 9C]
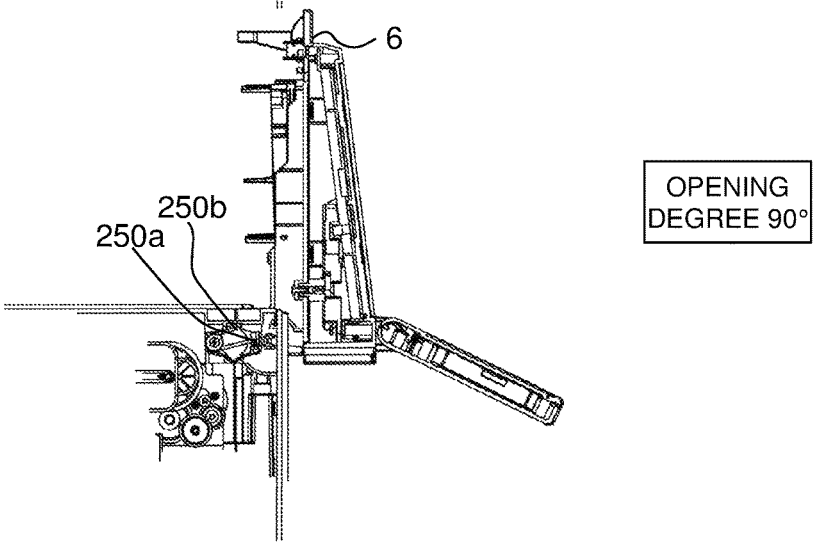

[FIG. 10]
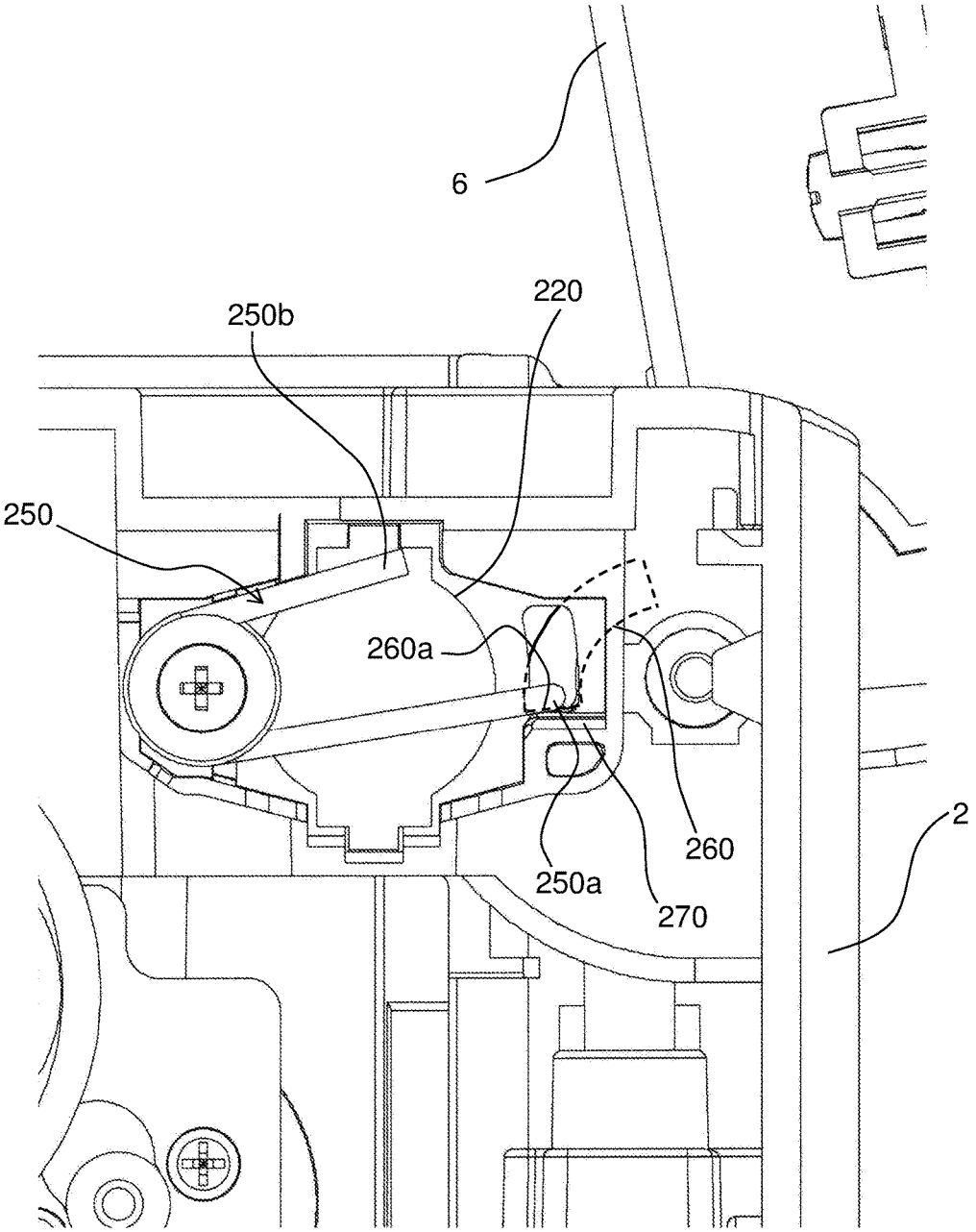

[FIG. 11]
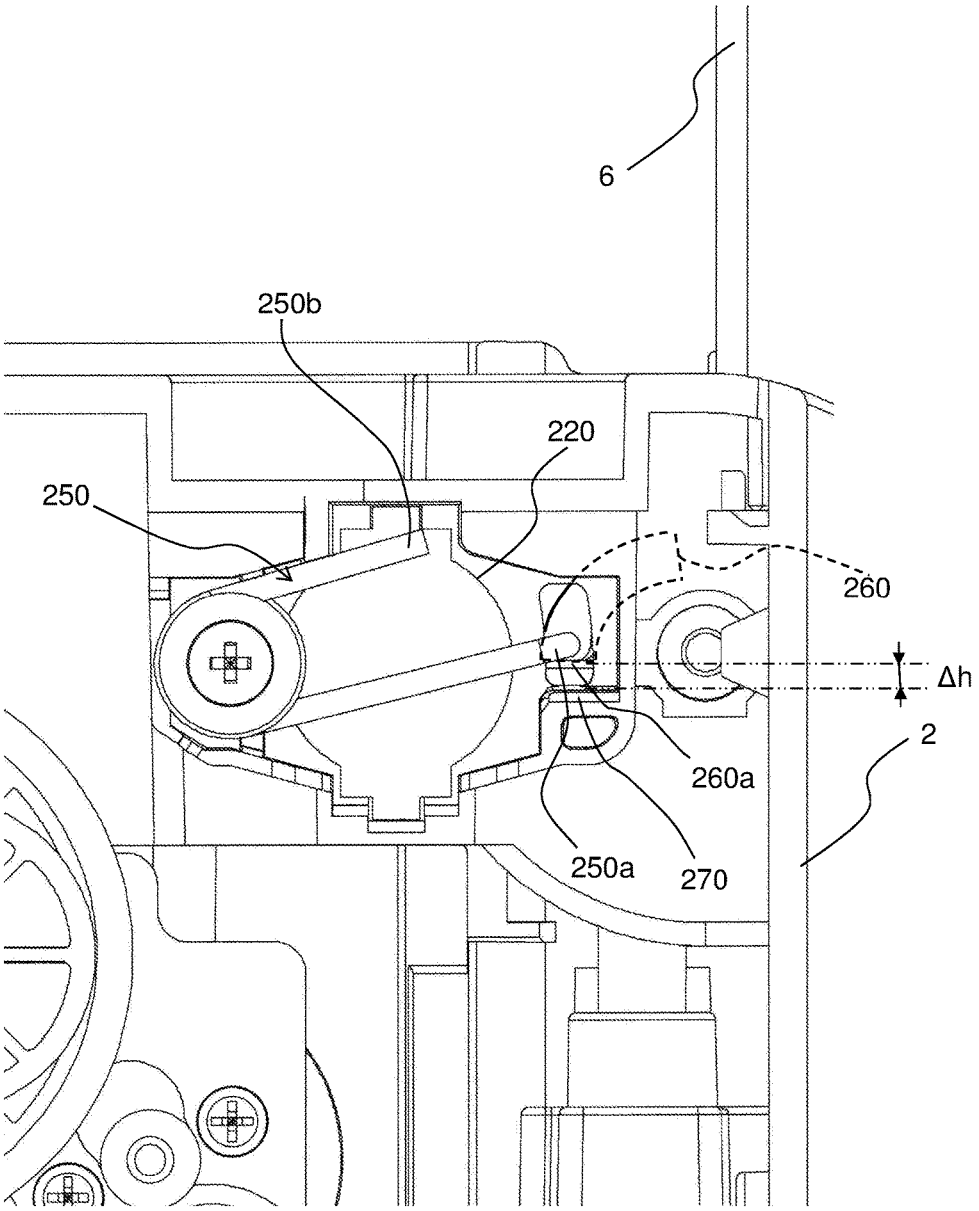

[FIG. 12]
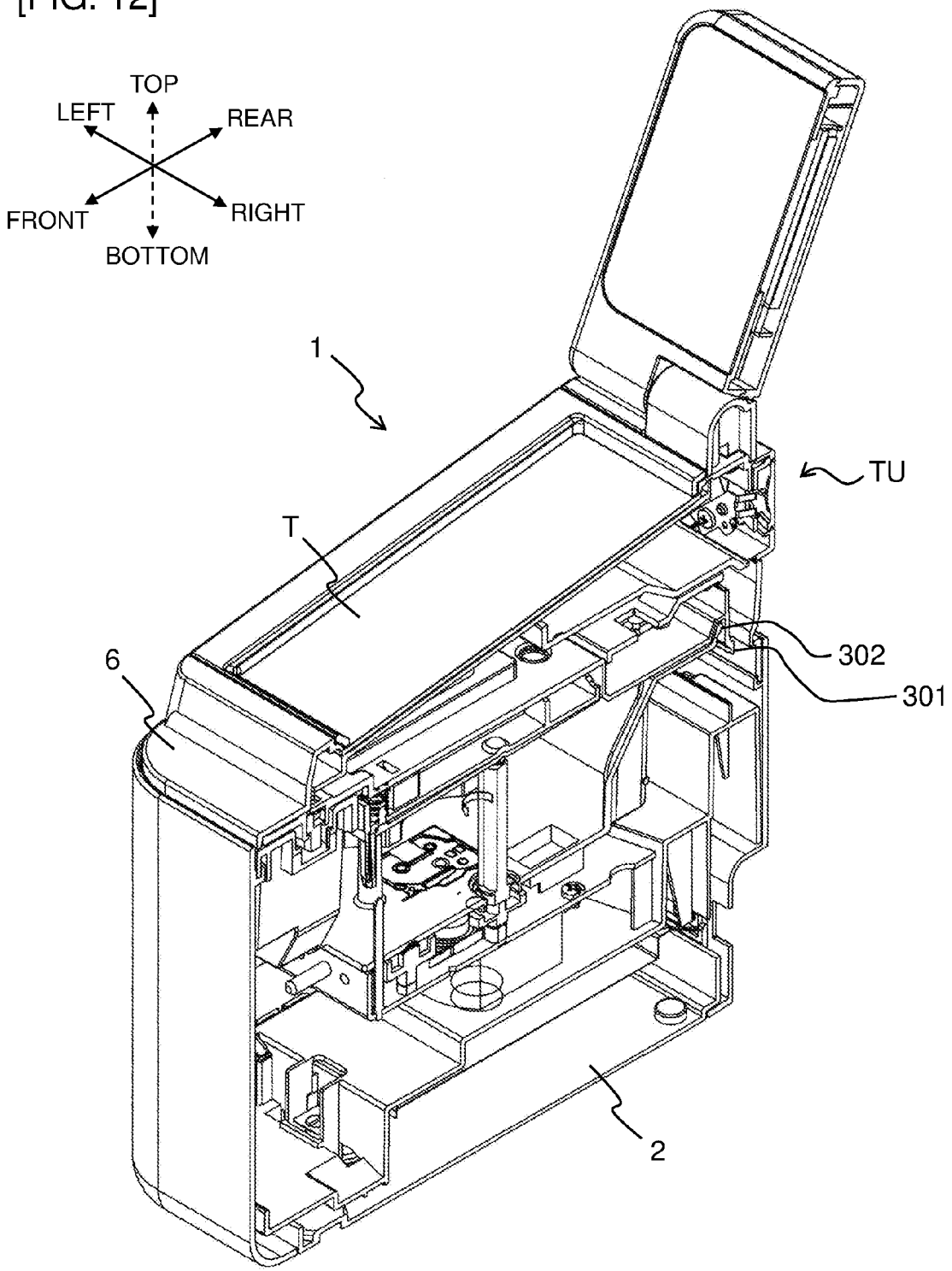

[FIG. 13A]
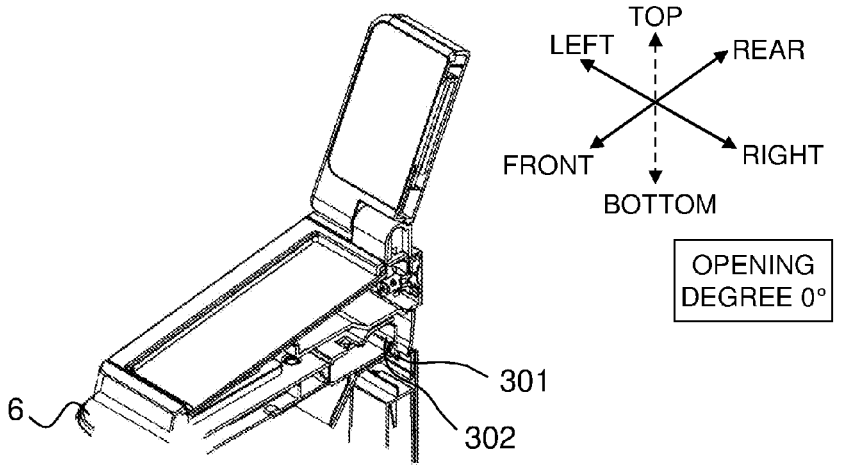
[FIG. 13B]
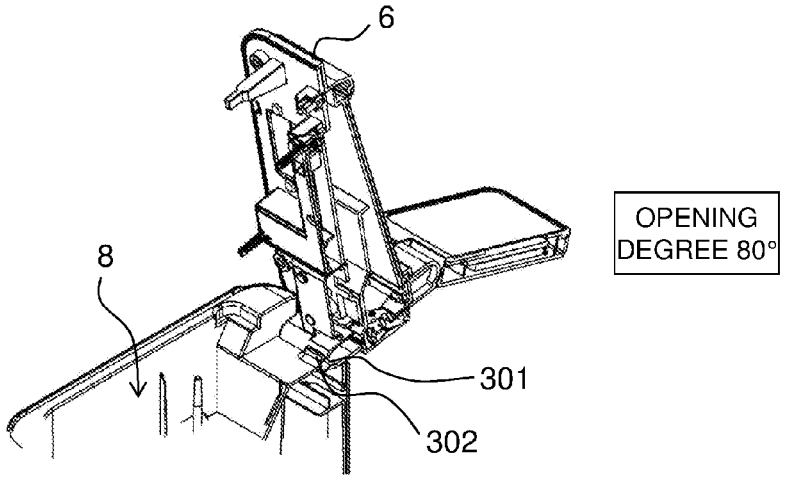
[FIG. 13C]
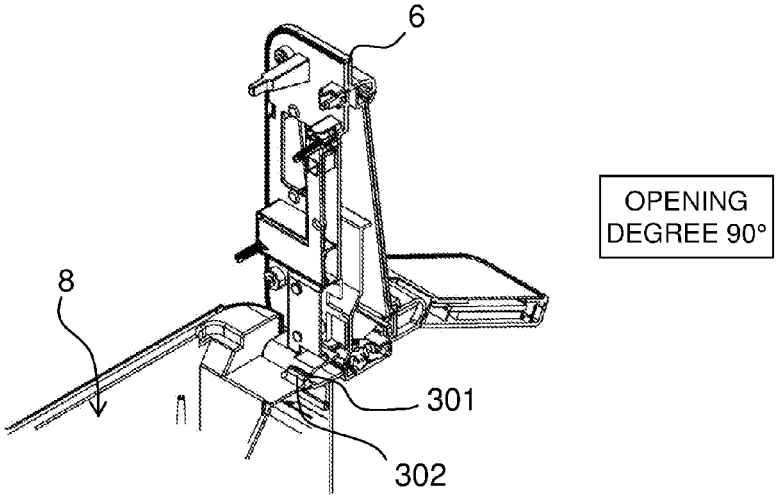

[FIG. 14A]
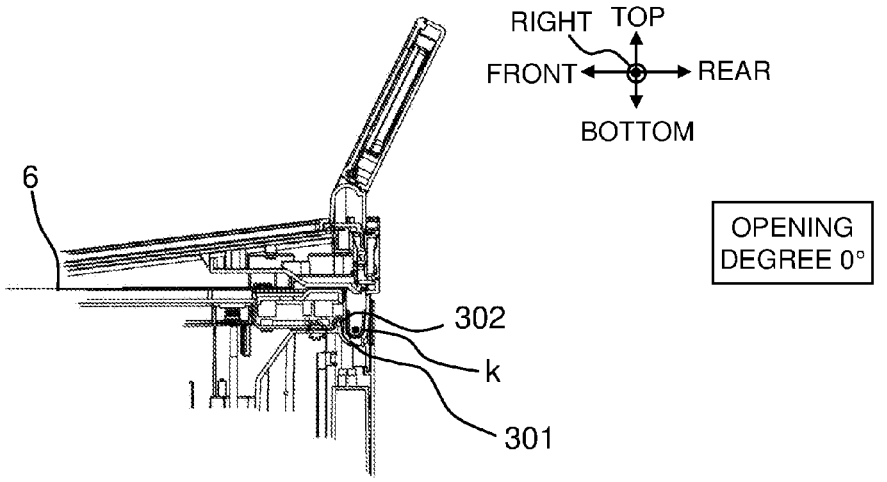
[FIG. 14B]
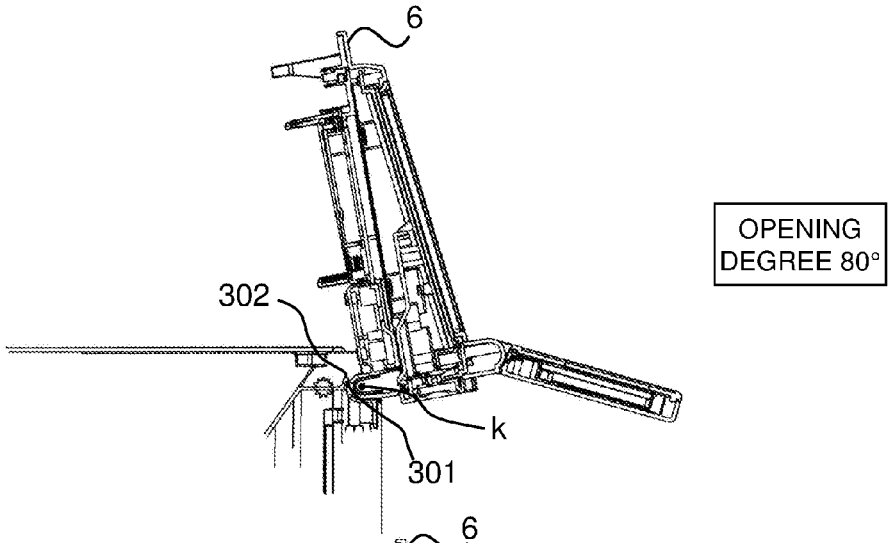
[FIG. 14C]
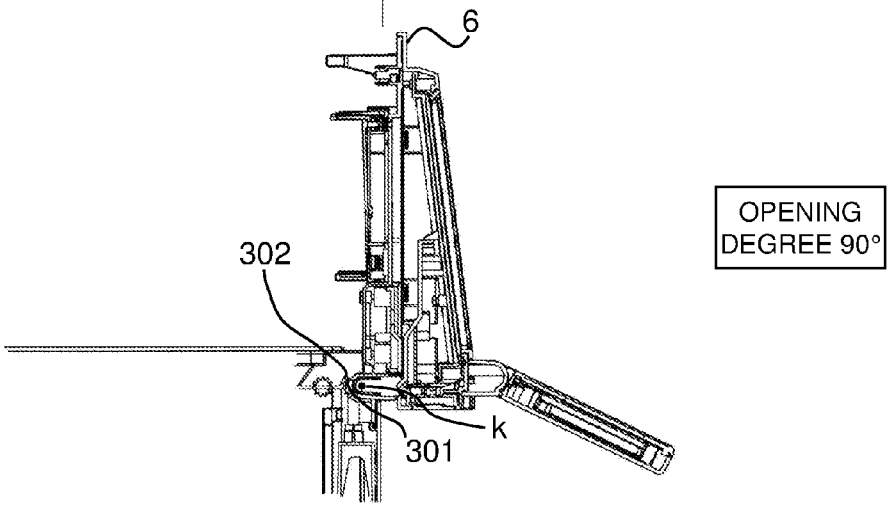

[FIG. 15]
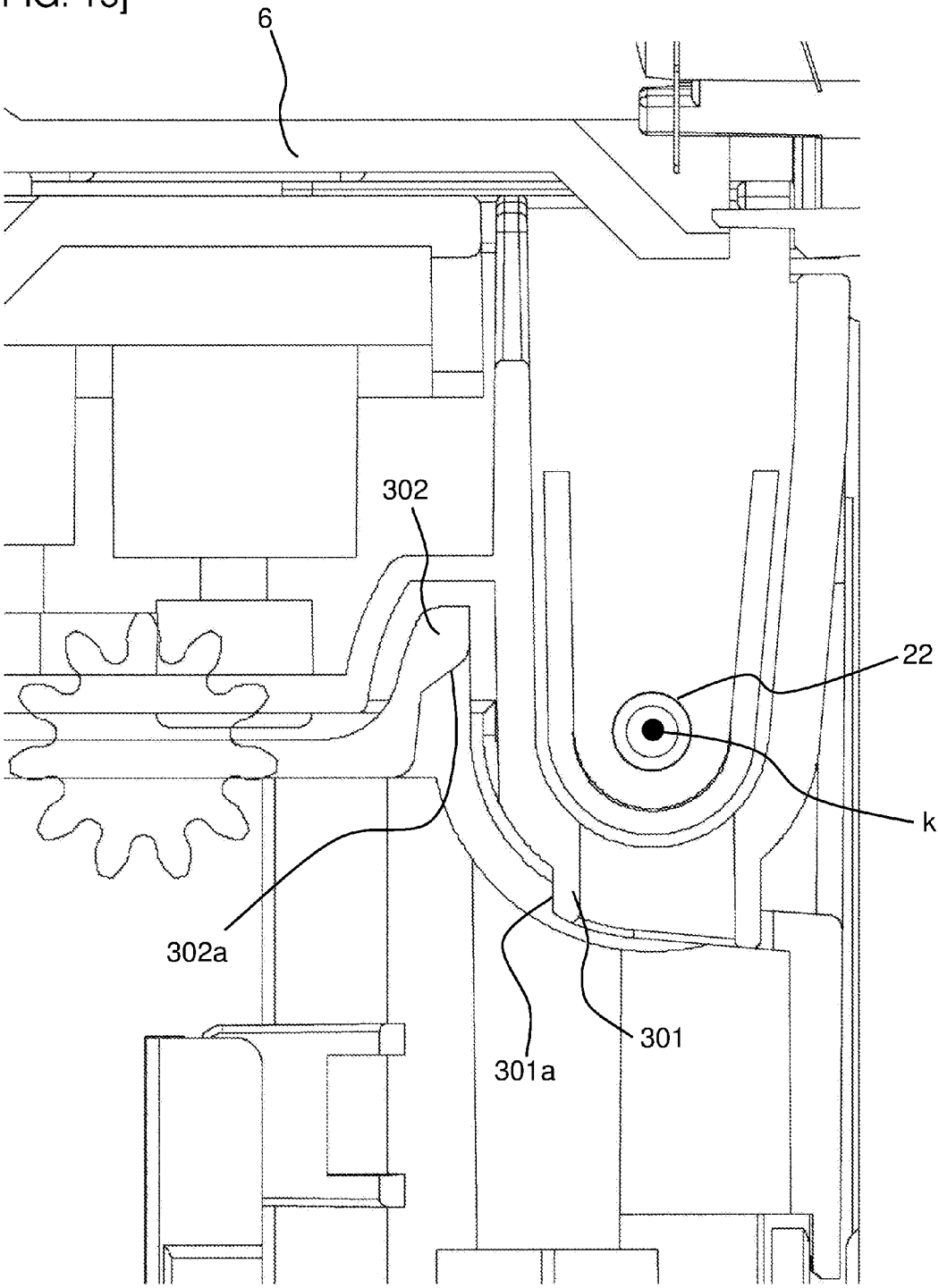

[FIG. 16]
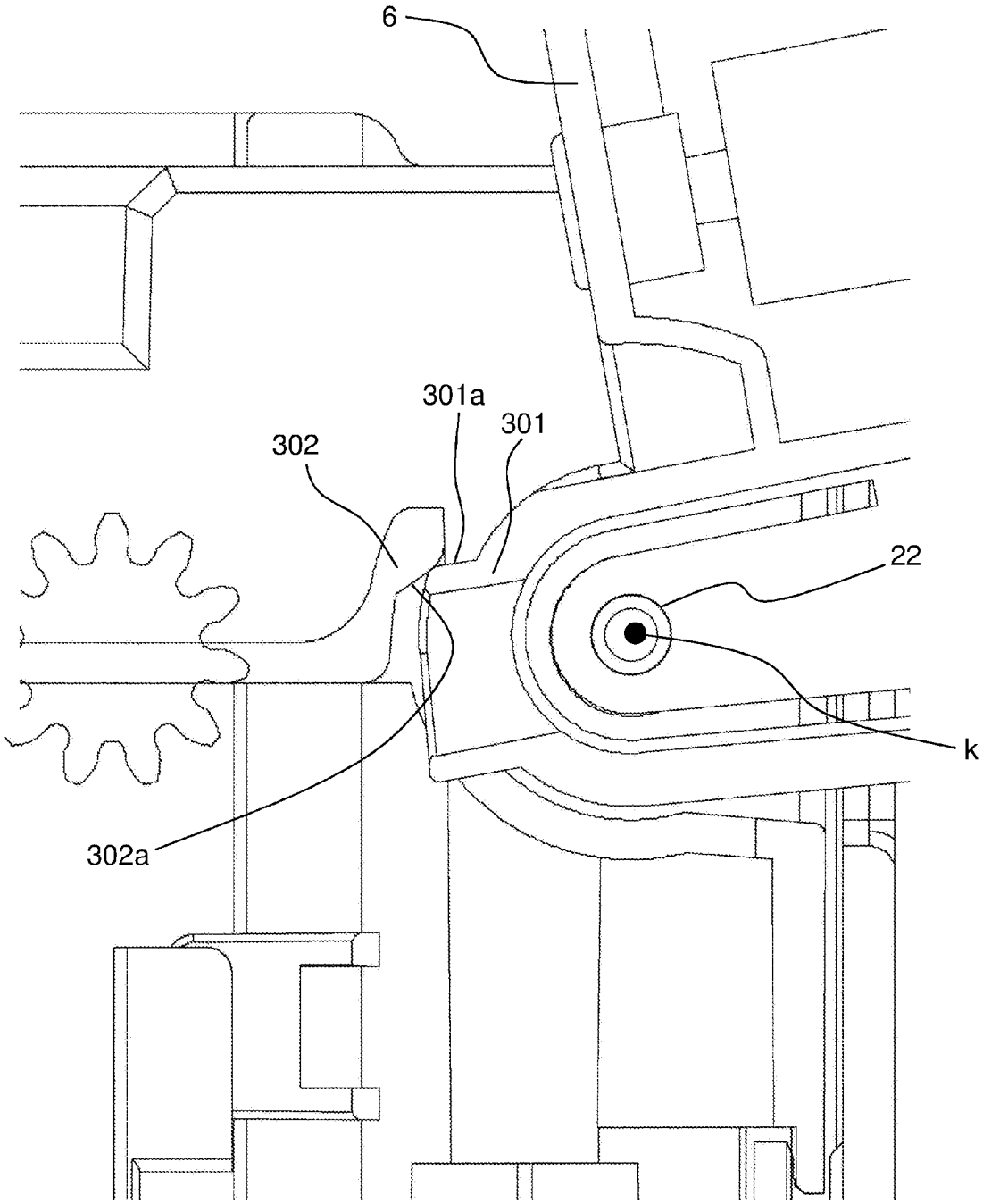

[FIG. 17]
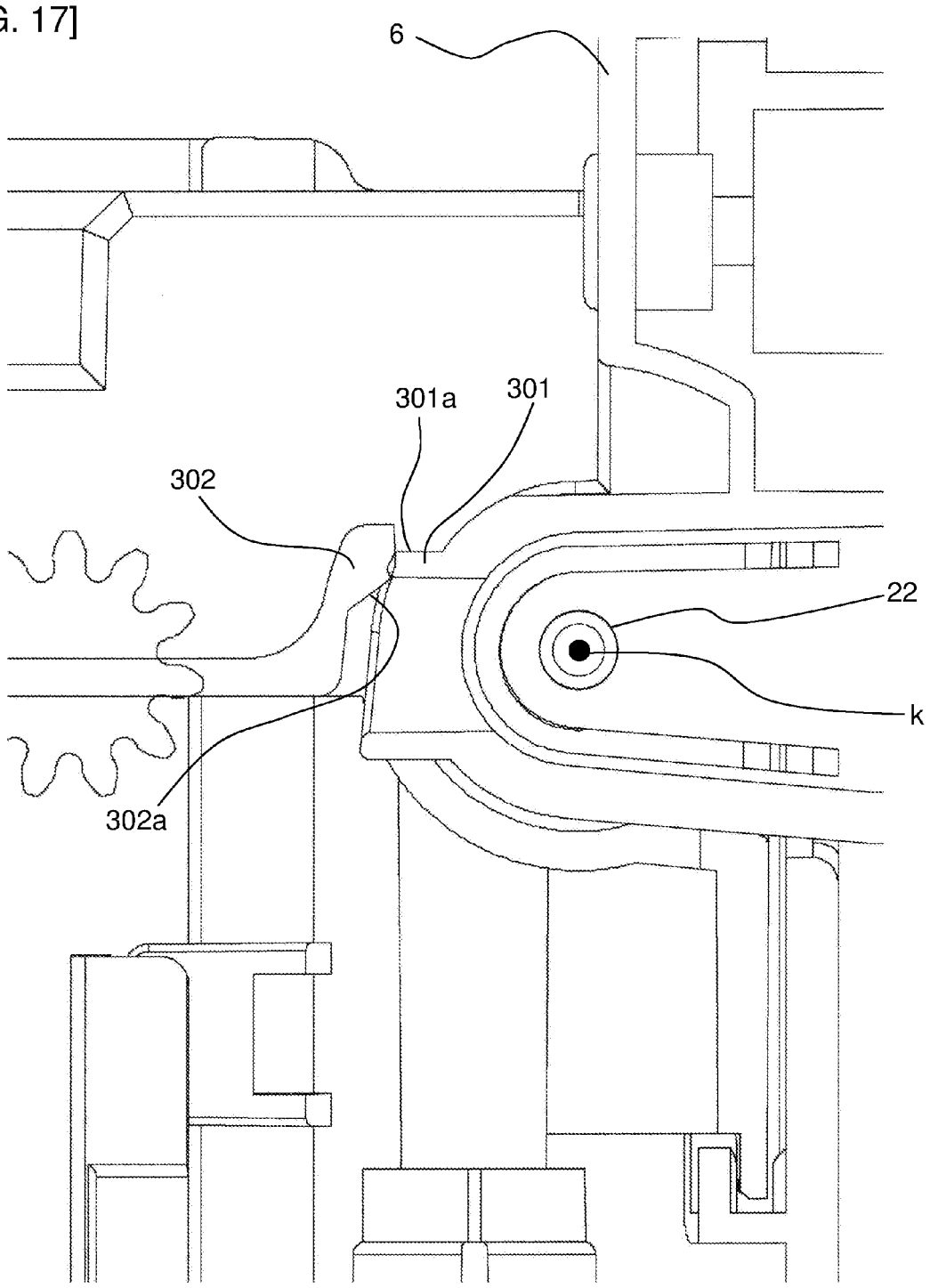

PRINTER

CROSS-REFERENCE TO RELATED APPLICATION

The present application claims priority from Japanese Patent Application No. 2016-55667, which was filed on Mar. 18, 2016, the disclosure of which is incorporated herein by reference in its entirety.

BACKGROUND

Field

The present disclosure relates to a printer performing printing on a print-receiving medium.

Description of the Related Art

A printer performing printing on a print-receiving medium is known. This printer (a label producing device) comprises a housing, a storage part (a roll storage part) provided on the housing and storing a print-receiving medium (a print-receiving tape), and an opening/closing lid (a housing cover part, a touch panel part) pivotally coupled to one side end portion of the housing.

The printer of the prior art has an operation part mounted on the opening/closing lid opening and closing the upper side of the storage part, so that the total weight of these components becomes comparatively heavy. Therefore, a spring member is provided to apply a comparatively large urging force to the opening/closing lid in the opening direction so as to achieve a stability improvement and an impact suppression when the opening/closing lid and the operating portion are closed. However, contrarily, this may consequently make a motion too fast when the opening/closing lid and the operation part are opened, and a bounce may occur at the completion of the opening motion.

SUMMARY

It is therefore an object of the present disclosure to provide a configuration capable of suppressing the occurrence of bounce at the completion of an opening motion in a printer having an operation part mounted on an opening/closing lid.

In order to achieve the above-described object, according to an aspect of the present application, there is provided a printer comprising a housing comprising a storage part configured to store a print-receiving medium, a printing part configured to perform printing on the print-receiving medium, an opening/closing lid that is coupled pivotally around an axis located on one side of the housing, and is configured to open and close an upper side of the storage part, an operation part configured to be detachably mounted on the opening/closing lid, a first spring member that applies an urging force in an opening direction to the opening/closing lid, and a second spring member configured to apply an urging force in a closing direction to the opening/closing lid, the second spring member being configured to be separated from the opening/closing lid without applying the urging force in the closing direction to the time the opening/closing lid has pivoted from a closed state in the opening direction by a first predetermined angle and to come into contact with the opening/closing lid to apply the urging force in the closing direction when the opening/closing lid has pivoted from the closed state in the opening direction by the first predetermined angle, the housing comprising a contacted part, and the opening/closing lid comprising a contacting part configured to be separated from the contacted part in the closed state, and to come into contact with the contacted part from the time the opening/closing lid has pivoted from the closed state in the opening direction by a second predetermined angle larger than the first predetermined angle to the time the opening/closing lid has pivoted in the opening direction by a third predetermined angle larger than the second predetermined angle.

In the printer of the present disclosure, the operation part is mounted on the opening/closing lid, so that the total weight thereof becomes comparatively heavy. Therefore, the first spring member is provided to apply a comparatively large urging force to the opening/closing lid in the opening direction, so that a stability improvement and an impact suppression can be achieved when the opening/closing lid and the operation portion forming a heavy load are closed. However, contrarily, a motion may become too fast in this state when the opening/closing lid and the operation part are opened, and a bounce may occur at the completion of the opening motion. Thus, in the present disclosure, the second spring member is provided so that an urging force can be applied to the opening/closing lid in the closing direction, and the contacted part provided on the housing and the contacting part provided on the opening/closing lid come into contact with each other in the opened state. As a result, while the opening/closing lid is urged in the closing direction at the timing near completion of the opening motion, the contacting part of the opening/closing lid separated then comes into contact with the contacted part of the housing at the completion of the opening motion of the opening/closing lid to absorb the impact. As a result, the occurrence of bounce can be suppressed.

In the present disclosure, when the opening/closing lid and the operation part are opened, the urging force of the second spring member is not exerted to the time the first predetermined angle, and the urging force is exerted after the first predetermined angle is reached. Therefore, while a comparatively fast opening speed is ensured partway without exerting the urging force in the closing direction, the occurrence of the bounce can reliably be suppressed by subsequently exerting the urging force in the closing direction. Additionally, in the present disclosure, when an opening angle (the second predetermined angle) larger than the first predetermined angle is reached, the contacting part of the opening/closing lid starts contacting with the contacted part of the housing. Since the contacting part further comes into contact with the contacted part after the second spring member exerts the urging force in the closing direction on the opening/closing lid and the operation part in this way, the force in the closing direction can smoothly be exerted in stages so that the occurrence of the bounce can reliably be suppressed.

BRIEF DESCRIPTION OF THE DRAWINGS

FIG. 1 is a perspective view of a configuration of a printer according to an embodiment of the present disclosure in a cover closed state.

FIG. 2 is a perspective view of the configuration of the printer in a cover opened state.

FIG. 3 is a perspective view of a state in which a touch panel unit is removed from a cover in the cover closed state.

FIG. 4 is a perspective view of a state in which the touch panel unit is removed from the cover in the cover opened state.

FIG. 5 is a breakaway perspective view of an arrangement position of a first spring member.

FIG. 6A is a breakaway perspective view sequentially showing an opening behavior of the cover.

FIG. 6B is a breakaway perspective view sequentially showing the opening behavior of the cover.

FIG. 6C is a breakaway perspective view sequentially showing the opening behavior of the cover.

FIG. 7A is a perspective view of a detailed structure of the cover.

FIG. 7B is a side view of the detailed structure of the cover.

FIG. 7C is a view of a damper in the direction of arrow A.

FIG. 7D is a perspective view of the damper.

FIG. 8 is a breakaway perspective view of an arrangement position of a second spring member.

FIG. 9A is a cross-sectional view sequentially showing an opening behavior of the cover.

FIG. 9B is a cross-sectional view sequentially showing the opening behavior of the cover.

FIG. 9C is a cross-sectional view sequentially showing the opening behavior of the cover.

FIG. 10 is an enlarged view of a main portion of FIG. 9B.

FIG. 11 is an enlarged view of a main portion of FIG. 9C.

FIG. 12 is a breakaway perspective view of positions of a contacting part of the cover and a contacted part of a housing.

FIG. 13A is a breakaway perspective view sequentially showing an opening behavior of the cover.

FIG. 13B is a breakaway perspective view sequentially showing the opening behavior of the cover.

FIG. 13C is a breakaway perspective view sequentially showing the opening behavior of the cover.

FIG. 14A is a cross-sectional view sequentially showing the opening behavior of the cover.

FIG. 14B is a cross-sectional view sequentially showing the opening behavior of the cover.

FIG. 14C is a cross-sectional view sequentially showing the opening behavior of the cover.

FIG. 15 is an enlarged view of a main portion of FIG. 14A.

FIG. 16 is an enlarged view of a main portion of FIG. 14B.

FIG. 17 is an enlarged view of a main portion of FIG. 14C.

DETAILED DESCRIPTION OF THE PREFERRED EMBODIMENTS

An embodiment of the present disclosure will now be described with reference to the accompanying drawings. If "front," "rear," "left," "right," "top," and "bottom" are noted in the drawings, "front," "rear," "left," "right," "top," and "bottom" in the description indicate the noted directions.

<Overall General Configuration>

First, an overall general configuration of a printer of this embodiment will be described with reference to FIGS. 1 to 4.

In FIGS. 1 and 2, a printer 1 is a general-purpose printer capable of supporting tape cassettes of various types such as a thermal type, a receptor type, a laminated type, etc. The printer 1 has a box-shaped housing 2 having the longitudinal direction defined in the font-rear direction, and a cover 6 provided on an upper surface of the housing 2 and opened and closed when a tape cassette (not shown) is replaced.

A touch panel unit TU (corresponding to an operation part) comprising a touch panel T is detachably attached to the cover 6 on the top side (anti-cassette storage part side) opposite to a cassette mounting part 8 (see FIG. 2 etc.). FIGS. 3 and 4 corresponding to FIGS. 1 and 2, respectively, show a state in which the touch panel unit TU is removed.

Returning to FIGS. 1 and 2, the cover 6 is a lid part having a substantially rectangular shape in a planar view. The cover 6 is rotatably supported by and around a hinge part 22 (see FIGS. 7A and 7B described later) located at an end portion on one side of the housing 2 and pivots around a rotation axis k extending in the left-right direction (see FIGS. 7A and 7B described later) to open and close the upper side of the cassette mounting part 8 formed inside the housing 2. The cover 6 can pivot between an opened position at which the cassette mounting part 8 is exposed (see, e.g., FIGS. 2 and 4) and a closed position at which the cassette mounting part 8 is covered (see, e.g., FIGS. 1 and 3).

A locking piece 21 is formed on a back surface of the cover 6 on the side facing the cassette mounting part 8. The locking piece 21 is formed at a position on the front side in the closed state of the cover 6. When the cover 6 is closed, the locking piece 21 engages with a locking mechanism 23 formed on a front side portion of an upper side surface of the housing 2 to maintain the closed state of the cover 6. An unlocking button 24 for an opening and closing operation of the cover 6 is provided on the front side portion of the upper side surface of the housing 2. By operating the unlocking button 24, the engagement of the locking piece 21 with the locking mechanism 23 is released and the cover 6 is put into an openable state.

A cassette pressing mechanism 100 is provided on the back surface of the cover 6. The cassette holding mechanism 100 comprises a pressing plate 110 that is a plate-shaped member formed in a substantially L-shape and presses a tape cassette (not shown) mounted on the cassette mounting part 8 from above when the cover 6 is closed, thereby holding the tape cassette inside the cassette mounting part 8.

The cassette mounting part 8 is a region in which a tape cassette capable of supplying a tape is stored such that the tape cassette can be attached and detached in the up-down direction. The cassette mounting part 8 is provided as a recess substantially corresponding to a shape of a bottom surface of the tape cassette. A head holder (not shown) equipped with a printing head 10 comprising heat generation elements is fixedly provided on a right portion of the cassette mounting part 8.

The front side surface of the housing 2 is disposed with a discharging slit 11 discharging to the outside a printed tape having a print formed thereon by the printing head 10 after being fed out from the tape cassette. A cutting mechanism (not shown) cutting the printed tape is provided on a transport path through which the printed tape is transported, before the slit 11 seen from the cassette mounting part 8.

Feature of Embodiment

As described above, the printer 1 of this embodiment has the touch panel unit TU mounted on the surface of the cover 6. As a result, since the total weight of these components becomes comparatively heavy, a first spring member 25 is provided.

<First Spring Member>

In particular, as shown in FIG. 5, the helical first spring member 25 is built into the hinge part 22. The first spring member 25 is in a pressurized state and has one end 25*a* locked to a rear side wall surface 2*a* of the housing 2 and the other end 25*b* locked to an end portion wall surface 6*a* on the rear side of the cover 6. As a result, the first spring member 25 always exerts a comparatively large urging force in the opening direction on the cover 6. Consequently, when the unlocking button 24 is operated to release the engagement of the locking piece 21 with the locking mechanism 23 as described above, the closed state (at the opening angle of 0°) of the cover 6 shown in FIG. 6A is changed to the opened state of the cover 6 shown in FIGS. 6A and 6C. FIG. 6B shows a state in which the cover 6 has pivoted around the rotation axis k by the opening angle of 80°, and FIG. 6C shows a state in which the cover 6 has pivoted around the rotational axis k by the opening angle of 90°.

As described above, the urging force of the first spring member 25 makes the opening motion of the cover 6 smooth and can achieve a stability improvement and an impact suppression when the cover 6 and the touch panel unit TU forming a heavy load are closed.

<Second Spring Member>

However, as a result of providing the first spring member comprising the large urging force as described above, contrarily, the motion may become too fast in this state when the cover 6 and the touch panel unit TU are opened, and a bounce may occur at the completion of the opening motion. Therefore, the second spring member 250 is provided in this embodiment.

A configuration of the second spring member 250 and a positional relationship with the cover 6 will be described with reference to FIGS. 7A and 7B.

As shown in FIGS. 7A and 7B, a semicircular arc-shaped tooth part 265 is provided around the rotation axis k in the vicinity of the hinge part 22 in the end portion on the rear side of the cover 6. The tooth part 265 meshes with a gear 220*a* of a damper 220 shown in FIGS. 7C and 7D so that the damper 220 buffers the opening and closing motion of the cover 6.

As shown in FIGS. 7A and 7B, a semicircular arc-shaped slit 260 is formed on the inner circumferential side of the tooth portion 265 of the cover 6. The helical second spring member 250 is disposed in the vicinity of the damper 220. The second spring member 250 comprises an engaging part 250*a* bent into an L-shape and a fixing part 250*b* on the opposite side. The engaging part 250*a* is engaged with the slit 260 and made slidable along the circular arc shape in the slit 260. On the other hand, the fixing portion 250*b* is locked to an appropriate upper wall surface 2*b* of the housing 2 (see FIG. 8 described later). As a result, the second spring member 250 can apply an urging force in the closing direction to the cover 6.

<Behavior of Urging Force Action by Second Spring Member>

The behavior of the second spring member 250 exerting the urging force in the closing direction on the cover 6 will be described with reference to FIGS. 8, 9, 10, and 11. As shown in FIG. 8, the housing 2 comprises a placing part 270 on which the engaging part 250*a* (inserted into and engaged with the slit 260 as described above) is placed with the fixing portion 250*b* of the second spring member 250 fixed to the upper wall surface 2*b*.

When the cover 6 is in the closed state as shown in FIG. 9A, the engaging part 250*a* has a root portion 250*a*A (see FIG. 7A) on the near side of FIG. 9A placed on the placing part 270 and a tip end portion 250*a*B (see FIG. 7A) on the far side of FIG. 9A inserted and loosely fitted into the slit 260. As a result, although the second spring member 250 is pressurized as described above, the urging force thereof does not act on the slit 260 (in other words, the cover 6) and the placing part 270 receives the urging force.

Subsequently, when the opening motion of the cover 6 as described above reaches a predetermined pivoting angle (the opening angle of 80° described above in this example, corresponding to a first predetermined angle), one end portion 260*a* (lower end) of the slit 260 pivoting together with the cover 6 comes into contact with the tip end portion 250*a*B of the engaging part 250*a* from below as shown in FIG. 9B and FIG. 10 that is an enlarged view of a main portion thereof. Therefore, in this state, while the tip end portion 250*a*B of the engaging part 250*a* is in contact with the one end portion 260*a* of the slit 260, the root portion 250*a*A of the engaging part 250*a* is in contact with the placing part 270.

Subsequently, when the opening motion of the cover 6 further proceeds, the one end portion 260*a* of the pivoting slit 260 pushes up the tip end portion 250*a*B from below, so that the root portion 250*a*A of the engaging part 250*a* separates from the placing part 270. As a result, the second spring member 250 starts applying the urging force in the closing direction to the cover 6. When the opening angle reaches 90° as shown in FIG. 9C and FIG. 11 that is an enlarged view of a main portion thereof, the engaging part 250*a* is separated from the placing part 270 by a height Δh (see FIG. 11). It is noted that the state shown in FIGS. 7A and 7B corresponds to the state at the pivoting angle of 90°.

As described above, while the cover 6 is pivoting from the closed state in the opening direction to the predetermined angle (the opening angle of 80°), the second spring member 250 does not apply the urging force in the closing direction because the engaging part 250*a* is placed on the placing part 270 and is separated from the one end portion 260*a* of the slit 260 of the cover 6. When the cover 6 has pivoted from the closed state in the opening direction by the predetermined angle (the opening angle of 80°), the second spring member 250 comes into contact with the one end portion 260*a* of the slit 260 of the cover 6 and applies the urging force in the closing direction.

<Contacting Structure Between Contacting Part of Cover and Contacted Part of Housing>

While the urging force of the second spring member 250 suppresses a bounce at the completion of the opening motion as described above, a contacted part provided on the housing 2 and a contacting part provided on the cover 6 come into contact with each other to further suppress the bounce in this embodiment. The details will be described with reference to FIGS. 12 to 17.

As shown in FIGS. 12 to 14, the housing 2 comprises a contacted part 302 on the front side relative to the rotation axis k (see FIG. 14). This contacted part 302 is formed like a projecting piece with an L-shaped cross-section in a rear upper portion of the housing 2 (see also FIGS. 15 to 17 described later).

The cover 6 comprises a contacting part 301 formed downward like a projecting piece from substantially the entire area in the width direction of the rear end portion. The contacting part 301 is separated in the closed state from, and brought into contact in the opened state with, the contacted part 302 (details will be described later).

<Contacting Behavior of Contacted Part and Contacting Part>

The behavior of the contacting part 301 and the contacted part 302 coming into contact with each other will be described with reference to FIGS. 12 to 14 and FIGS. 15 to 17.

As shown in FIGS. 12, 13A, 14A, and FIG. 15 that is an enlarged view of a main portion thereof, when the cover 6 is in the closed state (at the opening angle of 0°), the contacting part 301 is located vertically below the rotation axis k and separated from the contacted part 302 and is in a non-contacting state. In this state, as shown in FIG. 15, the contacted part 302 of the housing 2 comprises the first inclined surface 302*a* and the contacting part 301 of the cover 6 has a second inclined surface 301*a*.

Subsequently, as the opening motion of the cover 6 proceeds as described above, the contacting part 301 pivots around the rotation axis k (pivots clockwise in FIGS. 14 to 17). Even in the state at the opening angle of 80° (at which the second spring member 250 starts urging) shown in FIGS. 13B, 14B, and FIG. 16 that is an enlarged view of a main portion thereof, the contacting part 301 is not in contact with the contacted part 302 although coming extremely close thereto (FIGS. 13B, 14B, and 16 show the state immediately before the contact described later).

Subsequently, when the opening motion of the cover 6 further proceeds and reaches a certain opening angle (e.g., 81°, 85°, corresponding to the second predetermined angle) larger than the opening angle of 80° (at which the second spring member 250 starts urging), the contacting part 301 starts contacting with the contacted part 302. At the time of the contact with the contacted part 302, the second inclined surface 301*a* comes into contact with the first inclined surface 302*a* in a non-parallel state to the first inclined surface 302*a* (see FIG. 16 showing the state immediately before the contact).

As the opening angle of the cover 6 further increases after the contact, the second inclined surface 301*a* slides along the first inclined surface 302*a* or, in other words, the second inclined surface 301*a* and the first inclined surface 302*a* are brought into contact with each other such that the surfaces rub each other upward while moving a contact position of line contact. In a state shown in FIGS. 13C, 14C, and FIG. 17 that is an enlarged view of a main portion thereof, the opening motion has further proceeded to the opening angle of 90° (corresponding to a third predetermined angle) and, particularly, FIG. 17 shows a locked state of the contacting part 301 bending, and partially biting into, the contacted part 302. Therefore, the contacting part 301 is in contact with the contacted part 302 at the opening angle from 80° to 90° while bending the contacted part 302.

If the unlocking button 24 is operated to release the engagement of the locking piece 21 with the locking mechanism 23 as described above while the touch panel unit TU is removed as shown in FIGS. 3 and 4, the cover 6 moves in the opening direction due to the urging force of the first spring member 25 as described above. However, in this case, although the cover 6 pivots to the opening angle 80° and comes into contact with the second spring member 250 due to the urging force of the first spring member 25, the cover 6 does not rotate to the second predetermined angle (e.g., 81°, 85°) (at which the contacting part 301 and the contacted part 302 start contacting with each other) because of the urging force of the second spring member 250. In particular, the spring constants of the first spring member 25 and the second spring member 250 are set in advance so as to achieve such a form of motion.

In this way, when the touch panel unit TU is not mounted, the pivoting of the cover 6 does not reach the second predetermined angle (because of a light weight) and the contacting part 301 does not come into contact with the contacted part 302. Setting the minimum necessary spring force in this way can reduce manufacturing costs and restrain the durability from decreasing due to unnecessary contact between the contacting part 301 and the contacted part 302 when the touch panel unit TU is not mounted.

Advantage of Embodiment

As described above, in this embodiment, the second spring member 250 comes into contact with the one end portion 260*a* of the slit 260 of the cover 6 to apply the urging force to the cover 6 in the closing direction. The contacted part 302 provided on the housing 2 and the contacting part 301 provided on the cover 6 come into contact with each other in the opened state. While the cover 6 is urged in the closing direction at the timing near completion of the opening motion, the contacting part 301 of the cover 6 separated then comes into contact with the contacted part 302 of the housing 2 at the completion of the opening motion so as to absorb the impact. As a result, the occurrence of the bounce can be suppressed.

Particularly in this embodiment, when the contacted part 302 and the contacting part 301 come into contact with each other, the first inclined surface 302*a* and the second inclined surface 301*a* are brought into contact with each other such that the surfaces rub each other upward while moving a contact position of line contact, rather than bringing entire surfaces into contact with each other at a certain moment as in the case of the contact in a parallel state. Therefore, a sufficient impact absorption effect can be acquired additionally because of a friction effect at the time of the rubbing and a bending effect of the inclined surfaces 302*a*, 301*a*.

Particularly in this embodiment, while a comparatively large urging force is applied to the cover 6 in the opening direction by the first spring member 25 as described above, the damper 220 is provided for stabilizing the opening and closing speed. However, to ensure a certain level of opening motion speed without delaying the opening motion more than necessary, a degree of buffering by the damper 220 must be made relatively weak. In such a case, a bounce easily occurs at the completion of the opening motion of the cover 6 and, therefore, the bounce occurrence suppression effect by the second spring member 250 described above becomes particularly effective.

Particularly in this embodiment, because of the structure using the placing part 270 and the slit 260 described above, the urging force of the second spring member 250 is not exerted until the opening angle of 80° when the cover 6 is opened, and the urging force is exerted after exceeding 80°. Therefore, while a comparatively fast opening speed is ensured partway without exerting the urging force in the closing direction, the occurrence of the bounce can reliably be suppressed by subsequently exerting the urging force in the closing direction.

Particularly in this embodiment, the second spring member 250 can be pressurized by the placing part 270 and made on standby such that the urging force can effectively be generated. When the cover 6 is opened to the opening angle of 80°, the engaging part 250*a* (specifically, the root part 250*a*A) of the second spring member 250 in the standby state separates from the placing part 270 and comes into contact with the cover 6 (specifically, the one end portion 260 of the slit 260), so that the biasing force in the closing direction can reliably be exerted.

Particularly in this embodiment, when the certain opening angle (e.g., 81°, 85°) larger than the opening angle of 80° is reached, the contacting part 301 starts contacting with the contacted part 302. As a result, since the contacting part 301 further comes into contact with the contacted part 302 after the second spring member 250 exerts the biasing force in the closing direction on the cover 6, the force in the closing direction can smoothly be exerted in stages so that the occurrence of the bounce can reliably be suppressed.

Instead of storing the tape cassette in the cassette mounting part 8 as in the configuration described above, the present disclosure can be applicable to a configuration in which a tape roll capable of feeding out a tape used as a print-receiving medium is housed inside the housing 2 such that a print is formed by a printing head on the tape fed out from the tape roll. The same advantage as above is acquired also in this case.

It is noted that terms "vertical," "parallel," "plane," etc. in the above description are not used in the exact meanings thereof. Specifically, these terms "vertical," "parallel," "plane," etc. allow tolerances and errors in design and manufacturing and have meanings of "substantially vertical," "substantially parallel," and "substantially plane," etc.

It is noted that terms "same," "equal," "different," etc. in relation to a dimension and a size of the exterior appearance in the above description are not used in the exact meaning thereof. Specifically, these terms "same," "equal," "different," etc. allow tolerances and errors in design and manufacturing and have meanings of "substantially the same," "substantially equal," and "substantially different," etc.

The techniques of the embodiment and modification examples may appropriately be utilized in combination other than those described above.

What is claimed is:

1. A printer comprising:

a housing comprising a storage part configured to store a print-receiving medium, a printing part configured to perform printing on said print-receiving medium, an opening/closing lid that is coupled pivotally around an axis located on one side of said housing, and is configured to open and close an upper side of said storage part, an operation part configured to be detachably mounted on said opening/closing lid, a first spring member that applies an urging force in an opening direction to said opening/closing lid, and a second spring member configured to apply an urging force in a closing direction to said opening/closing lid, said second spring member being configured to be separated from said opening/closing lid without applying said urging force in the closing direction from a closed state to a point where said opening/closing lid has pivoted from the closed state in the opening direction by a first predetermined angle, the second spring member further being configured to come into contact with said opening/closing lid to apply said urging force in the closing direction at the point where said opening/closing lid has pivoted from said closed state in the opening direction by said first predetermined angle, said housing comprising a contacted part, and said opening/closing lid comprising a contacting part configured to be separated from said contacted part in said closed state, and to come into contact with said contacted part from a point where said opening/closing lid has pivoted from said closed state in the opening direction by a second predetermined angle larger than said first predetermined angle to the point where said opening/closing lid has pivoted in the opening direction by a third predetermined angle larger than said second predetermined angle.

2. The printer according to claim 1, wherein said opening/closing lid is configured to pivot between an opened position at which said storage part is exposed and a closed position at which said storage part is covered.

3. The printer according to claim 1, wherein:

said contacted part of said housing comprises a first inclined surface, and said contacting part of said opening/closing lid comprises a second inclined surface configured to come into contact with said first inclined surface in a non-parallel state to said first inclined surface at the time of contact with said contacted part.

4. The printer according to claim 1, further comprising a buffering part configured to buffer an opening and closing motion of said opening/closing lid.

5. The printer according to claim 1, wherein said storage part is a cassette mounting part configured to attach and detach a tape cassette configured to supply a tape as said print-receiving medium.

6. The printer according to claim 5, wherein said opening/closing lid comprises a cassette pressing mechanism configured to, in the case that said opening/closing lid is closed, press said tape cassette mounted on said cassette mounting part from above to hold said tape cassette in said cassette mounting part.

7. A printer comprising:

a housing comprising a storage part configured to store a print-receiving medium;

a printing part configured to perform printing on said print-receiving medium;

an opening/closing lid that is coupled pivotally around an axis located on one side of said housing, and is configured to open and close an upper side of said storage part;

an operation part configured to be detachably mounted on said opening/closing lid;

a first spring member that applies an urging force in an opening direction to said opening/closing lid; and a second spring member configured to apply an urging force in a closing direction to said opening/closing lid, said second spring member being configured to be separated from said opening/closing lid without applying said urging force in the closing direction from a closed state to a point where said opening/closing lid has pivoted from the closed state in the opening direction by a first predetermined angle, the second spring member further being configured to come into contact with said opening/closing lid to apply said urging force in the closing direction at the point where said opening/closing lid has pivoted from said closed state in the opening direction by said first predetermined angle, said housing comprising a contacted part, said opening/closing lid comprising a contacting part configured to be separated from said contacted part in said closed state, and to come into contact with said contacted part from a point where said opening/closing lid has pivoted from said closed state in the opening direction by a second predetermined angle larger than said first predetermined angle to the point where said opening/closing lid has pivoted in the opening direction by a third predetermined angle larger than said second predetermined angle, said housing comprises a holding part that fixes one end portion of said second spring member where the second spring member is pressurized in advance, and movably holds another end portion of the second spring member, and said second spring member is configured to apply said urging force in the closing direction to said opening/closing lid, as a result of said opening/closing lid having pivoted by said first predetermined angle coming into contact with said other end portion and the other end portion separating from said holding part.

8. The printer according to claim 7, wherein said holding part comprises a placing part on which said other end portion is placed while said one end portion of said second spring member is fixed to said housing.

9. A printer comprising:

a housing comprising a storage part configured to store a print-receiving medium, a printing part configured to perform printing on said print-receiving medium, an opening/closing lid that is coupled pivotally around an axis located on one side of said housing, and is configured to open and close an upper side of said storage part, an operation part configured to be detachably mounted on said opening/closing lid, a first spring member that applies an urging force in an opening direction to said opening/closing lid, and a second spring member configured to apply an urging force in a closing direction to said opening/closing lid, said second spring member being configured to be separated from said opening/closing lid without applying said urging force in the closing direction from a closed state to a point where said opening/closing lid has pivoted from the closed state in the opening direction by a first predetermined angle, the second spring member further being configured to come into contact with said opening/closing lid to apply said urging force in the closing direction at the point where said opening/closing lid has pivoted from said closed state in the opening direction by said first predetermined angle, said housing comprising a contacted part, said opening/closing lid comprising a contacting part configured to be separated from said contacted part in said closed state, and to come into contact with said contacted part from a point where said opening/closing lid has pivoted from said closed state in the opening direction by a second predetermined angle larger than said first predetermined angle to the point where said opening/closing lid has pivoted in the opening direction by a third predetermined angle larger than said second predetermined angle, said printer further comprising:

a locking unit configured to lock an opening motion of said opening/closing lid due to said first spring member so as to put said opening/closing lid into said closed state; and an unlocking unit configured to release the lock by said locking unit, and said opening/closing lid is configured to, in the case that said unlocking unit releases said lock while said operation part is not mounted, not only come into contact with said second spring member at the time that said opening/closing lid has pivoted by said first predetermined angle due to said urging force of said first spring member but also stop pivoting before said second predetermined angle because of said urging force of the second spring member.

10. The printer according to claim 9, wherein said locking unit is provided on the other side of both said opening/closing lid and said housing in said closed state of said opening/closing lid.

11. The printer according to claim 10, wherein said unlocking unit is provided on the other side of both said opening/closing lid and said housing in said closed state of said opening/closing lid.

* * * * *